US006200450B1

(12) United States Patent
Hui

(10) Patent No.: US 6,200,450 B1
(45) Date of Patent: Mar. 13, 2001

(54) METHOD AND APPARATUS FOR DEPOSITING NI-FE-W-P ALLOYS

(76) Inventor: Wen Hua Hui, #1 Highgate Dr., Apt. 208, Ewing, NJ (US) 08618

( * ) Notice: Subject to any disclaimer, the term of this patent is extended or adjusted under 35 U.S.C. 154(b) by 0 days.

(21) Appl. No.: 09/281,482

(22) Filed: Mar. 30, 1999

Related U.S. Application Data

(60) Provisional application No. 60/079,842, filed on Mar. 30, 1998.

(51) Int. Cl.[7] ..... C25D 3/56; C25D 21/12

(52) U.S. Cl. ..... 205/82; 204/224 R; 204/228.7; 205/84; 205/104; 205/109; 205/258

(58) Field of Search ..... 204/224 R, 228.7; 205/82, 84, 104, 109, 258

(56) References Cited

U.S. PATENT DOCUMENTS 4,287,043 * 9/1981 Eckert et al. ..... 204/228
4,786,376 * 11/1988 Vaaler ..... 204/3
5,433,797 * 7/1995 Erb et al. ..... 148/304
5,614,003 * 3/1997 Mallory ..... 106/1.22

* cited by examiner

*Primary Examiner*—Kathryn Gorgos
*Assistant Examiner*—William T. Leader
(74) *Attorney, Agent, or Firm*—Dilworth & Barrese, LLP

(57) ABSTRACT

A method is described for electrodepositing an alloy of Ni-Fe-W-P. The alloy has good corrosion and wear resistance and hence is a possible replacement for hard chromium. The electrodeposition solution contains nickel ions, iron ions, tungsten ions and phosphorous ions, and a reducing agent. The solution yields high iron content, bright level alloy deposits containing up to 40 percent iron. In another aspect of the invention, electrodeposition is carried out on a surface containing a geometric error. A sensor determines the surface topography of the surface. This is compared in a microprocessor to the desired topography. A corrective signal is sent to an electric current source to cause electrodeposition of a quantity of leveling agent sufficient to at least partially correct the geometric error.

21 Claims, 11 Drawing Sheets

Mechanism of leveling

The Distribution of leveling agent ion 1. 1.0 mol/ρ $NaSO_4$ + 4.0 mol/ρ $H_3BO_3$
2. 1+2.0 mol/ρ Leveling agent
3. 1+0.5 mol/ρ $FeSO_4$
4. 1+0.5 mol/ρ $NiSO_4$
5. 1+0.5 mol/ρ $FeSO_4$ +0.5 mol/ρ $NiSO_4$
6. 2+0.5 mol/ρ $FeSO_4$
7. 2+0.5 mol/ρ $NiSO_4$
8. 2+0.5 mol/ρ $FeSO_4$ +0.5 mol/ρ $NiSO_4$ Polarization carver of hydrogen evolution(1,2) and electrodeposition Fe(3,6), Ni(4,7) and Ni+Fe(5,8) on holding Hg electrode FIGS. 4(a), 4(b) and 4(c) depict the correlation between the geometric error of the shaft, the pulse sequence and movement speed of the plating applicator with the shaft length.

FIG. 5 Test result of surface smoothness

Before plating

After plating

The anodic polarization cuves of electrodeposited Ni–Fe,Ni–P,Ni–Fe–P, and Ni–Fe–W–P deposits The anodic polarization cuves of Ni–Fe based alloy deposits, and SUS304 in HCl solution The anodic polarization curves of Ni–Fe–P–W deposits with different W contents The anodic polarization curves of electrodeposited Ni–P and Ni–Fe–W–P alloy deposits in $H_2SO_4$ solution (a) before corrosion (b) after corrosion Results of EDAX analyses of Ni–Fe–W–P plating layer before and after corrosion (a) for W (b) for Ni
Results of XPS analyses of reaction film
1: before sputtering 2: sputter time of 80 min.

(a) before corrosion (b) after corrosion

Results of AES analyses of passive film on Ni–Fe–W–P plating layer before and after corrosion

METHOD AND APPARATUS FOR DEPOSITING NI-FE-W-P ALLOYS

CROSS REFERENCE TO RELATED APPLICATIONS

This application claims priority to U.S. Provisional Application Ser. No. 60/079,842 filed Mar. 30, 1998.

BACKGROUND

1. Technical Field

The present disclosure relates to Ni-Fe-W-P alloys and a method and apparatus for depositing same.

2. Background of Related Art

Chromium plating offers unique deposit properties, including brightness, discoloration stability at atmospheric conditions and long preservation of the luster. But uniformity of the deposits is poor, the required current density is high, current efficiency is low, and the cost of energy is great. At the same time, chromium ions are very poisonous. Any chromium mist that escapes or direct drainage of waste water containing chromium ions can greatly contaminate atmosphere and water sources, adversely affecting the health of humans.

It would be desirable to provide the beautiful color and luster, good corrosion resistance and excellent wear resistance such as those of chromium deposits without the aforementioned shortcomings. Many substitutes for chromium deposits have been investigated and developed, of which, up to now, Sn-Co alloy seemed to be the most promising. See, U.S. Pat. Nos. 3,966,564 and 3,951,760, the disclosures of which are incorporated herein by reference.

Compared with chromium plating deposits, Sn-Co alloy deposits have the following advantages:

1. Sn-Co alloy deposits have the same excellent luster and beautiful color as chromium deposits and can be used as decorative deposits.
2. Corrosion resistance of Sn-Co alloy deposits is superior to that of chromium deposits and can be used as advanced protection deposits.
3. Sn-Co alloy deposits have good adhesion, excellent toughness, low internal stress, no porosity and no cracks.
4. Dispersing and penetrating abilities are very good. Throwing and covering power are very good.
5. Current efficiency of Sn-Co alloy plating is one to four times higher than that of chromium plating.
6. Because Sn-Co alloy plating is not poisonous, draining waste gas and water can be easily handled.

But the hardness of Sn-Co alloy deposits is about HV 500–600 and wear resistance is only one half that of chromium plating deposits.

In order to overcome the disadvantages of Sn-Co alloy various alloy plating deposits have been developed as substitutes. For example, U.S. Pat. No. 4,529,668 discloses a W-Co-B electrodeposition alloy.

U.S. Pat. No. 5,614,003 discloses electroless deposition of Ni-Mo-P, Ni-Cu-P, Ni-Sn-P, Co-W-P and Ni-W-P combinations. These coatings have high hardness, good wear resistance and good corrosion resistance, but suffer from such problems as low current efficiency and high energy cost. For example, the electrodeposition rate of W-Co-B is only about 1.6 $\mu$m–50 $\mu$m per six hours at a solution temperature of 72–86° C.

In order to overcome these disadvantages of prior known deposition compositions and methods the present method has been developed.

SUMMARY OF THE INVENTION

In one aspect, a method is provided herein for electrodepositing a metallic coating onto a surface of an object. The method comprises the steps of: preparing an electrodeposition fluid which contains in solution, based on the total metal content of the solution, from about 65 percent to about 70 percent nickel, about 10 percent to about 30 percent by weight of iron, about 5 percent to about 10 percent by weight of tungsten, and about 1 percent to about 3 percent phosphorous; mounting the object on a support; providing an anode which is movable over the object, the anode having an applicator in contact with a first portion of the surface of the object, a second portion of the surface of the object not being in contact with the applicator; supplying the electrodeposition fluid to the applicator; and supplying electric current to the anode and to the object to deposit an alloy containing nickel, iron, tungsten and phosphorous onto the object.

The method advantageously provides for the deposition of a Ni-Fe-W-P alloy having good corrosion and wear resistance with high current efficiency and low energy cost.

Also provided herein is an apparatus for electrodepositing a metallic coating from a working solution onto a surface of an object, comprising: a support for mounting the object, the support being rotatable around a horizontal axis; an anode; transport means for reciprocatingly moving the anode in a horizontal direction parallel to the axis of the support; an applicator attached to the anode for contacting a selected portion of the surface of the object; a fluid supply communicating with the applicator for supplying working solution to the selected portion of the surface of the object; a power supply connected to the anode for creating an electrical potential between the object and the anode; and a microprocessor containing logic therein for effectuating correction of geometric error in surface topography of a platable object, the microprocessor being operatively connected to the power supply.

Additionally, a method is provided herein for leveling the surface of a platable object comprising: providing a platable object operatively mounted to an electrodeposition apparatus, the platable object having a surface containing a geometric error in its surface topography; providing a sensor for determining the surface topography of the object and generating a first signal corresponding to the surface topography; sending the first signal to a microprocessor which compares the geometric error to a value corresponding to a desired surface topography of the object; calculating the magnitude of the geometric error from the difference between the actual surface topography and the desired surface topography of the object; generating a corrective signal corresponding to the magnitude of the geometric error; and sending the corrective signal to an electric current source thereby causing the electrodeposition apparatus to deposit onto the surface of the object a quantity of leveling agent sufficient to at least partially correct the geometric error of the platable object.

Also provided herein is an electrodeposition fluid which contains in solution, based on the total metal content of the solution, from about 5 percent to about 15 percent iron, about 75 percent to about 90 percent nickel, about 3 percent to about 15 percent tungsten and about 0.5 percent to about 4.0 percent phosphorous, and a reducing agent.

BRIEF DESCRIPTION OF THE DRAWINGS

Various embodiments are described below with reference to the drawings wherein.

DETAILED DESCRIPTION OF PREFERRED EMBODIMENTS

Figure 1:
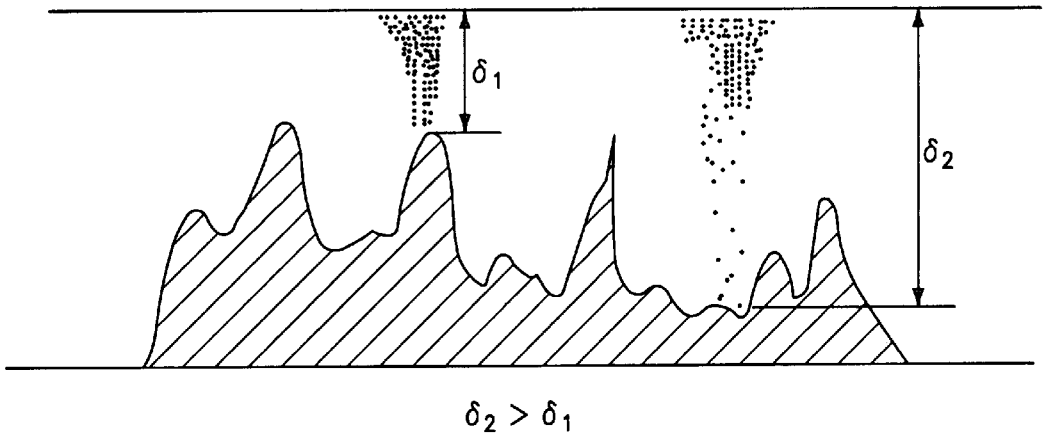
FIG. 1 is a graphical depiction of the electrodeposited alloy on the surface of substrate having irregularities.

All composition percentages herein are given by weight unless indicated otherwise.

The alloy deposited in accordance with the electrodeposition fluid and method described herein is a Ni-Fe-W-P alloy having the following range of composition percentages by weight:

| | |
|---|---|
| Ni | about 65% to about 70% |
| Fe | about 10% to about 30% |
| W | about 5% to about 10% |
| P | about 1% to about 3% |

Appropriate contents of Ni and Fe in an electrodeposited alloy can result in a coating having color that is similar to that of chromium. Fe in a solid solution of Ni can increase its hardness and thermodynamic stability.

The electrodeposition fluid, an aqueous plating solution which includes a combination of metals and a reducing agent having complexing and leveling properties, can contain from about 5 to about 15 percent iron, from about 75 to about 90 percent nickel, from about 3 to about 15 percent tungsten and from about 0.5 to about 4.0 percent phosphorous. Preferably, the plating solution contains between about 4 percent to about 8 percent iron, about 80 percent to about 84 percent nickel, about 5 percent to about 9 percent tungsten and about 1 percent to about 3 percent phosphorous.

Iron can be provided in the plating solution in any soluble form. Thus, for example, iron can be incorporated into the plating solution as ferrous sulfate ($FeSO_4$), ferrous chloride, ferrous fluoborate, ferrous sulfamate and the like. Likewise, nickel can be provided in any soluble form such as, for example nickel sulfate ($NiSO_4$), nickel chloride, nickel sulfamate and the like. Suitable soluble tungsten compounds that can be used in forming the plating solution include, for example, $NaWO_4$ and $HWO_4$. Phosphorous can be provided as any of the phosphorous-containing acids or salts thereof. Exemplary phosphorous compounds include $H_3PO_3$ and $NaH_2PO_2$.

Iron should be present predominantly in the form of $Fe^{+2}$. A small amount of $Fe^{+3}$ (0.1–0.2 g/l) is desirable in a plating solution in that it helps to promote smooth, brighter and more level deposits. However, excessive amount of $Fe^{+3}$ (usually at least 1 g/l or more) will severely hurt the physical properties of the deposit as well as the appearance. Furthermore, when the alloy deposit exceeds 30% iron, the amounts of $Fe^{+3}$ present in solution becomes critical. $Fe^{+3}$ concentrations which would not normally interfere in typical alloy deposits, such as those containing about 20 to 25% iron, become quite harmful when the iron in the alloy exceeds 30%. Moreover, higher iron alloy compositions require substantially higher total iron ion concentration in the solution, and therefore, the $Fe^{+3}$ concentration is more likely to be excessive.

It is also contemplated that a ceramic powder can be included in the plating solution to further improve wear resistance and hardness. Suitable ceramic materials include alumina ($Al_2O_3$), silicon nitride ($Si_3N_4$), zirconia ($ZrO_2$), titania ($TiO_2$), chromium oxide ($CrO_3$), boron carbide ($B_4C$), and diamond. The particle size of the ceramic powder should be from about 1 $\mu$m to about 8 $\mu$m, preferably about 3 to about 5 $\mu$m. The amount of ceramic powder used in the plating solution can range from about 2 to about 8 g/l. Preferably from about 4 to about 6 g/l.

By introducing a reducing agent into the high iron alloy solution the $Fe^{+3}$ can now be reduced to a minimum and thereby its harmful effect is limited. The reducing agent can have complexing agent and leveling agent properties. Suitable reducing agents include ascorbic acid, isoascorbic acid, maleic acid, muconic acid, muconic glucoheptonate, sodium hydroquinone benzyl either and aspartic acid. The reducing agent is present in the plating solution in an amount from about 2.0 to about 60 g/l. Preferably for ascorbic acid, isoascorbic acid, maleic acid and muconic acid the concentration of the reducing agent is about 2 g/l to about 4 g/l. For glucoheptonate, sodium hydroquinone benzyl ether and aspartic acid the concentration is preferably about 30 g/l to about 50 g/l. The plating solution can include one or more reducing agents.

By using a reducing agent, bright leveled iron alloy deposits can be consistently obtained at alloy composition which exceed about 35% iron inclusion. Generally it is preferred to utilize from about 10 to about 60 grams per liter of a reducing agent.

The pH of the plating solution can be adjusted by the addition of buffers such as NaOH or $H_2SO_4$, if necessary, to a range of from about pH 2.0 to about pH 3.0, preferably from about pH 2.5 to about pH 2.0

The present Ni-Fe-W-P alloys can be deposited on a substrate using any known technique, such as, for example electroplating or electroless deposition. One particularly useful deposition technique is brush plating. Various methods and apparatus for brush plating are known such as those disclosed in U.S. Pat. Nos. 5,453,174; 5,324,406; 4,452,684; 4,404,078; 3,751,343; and 3,290,236 the disclosures of which are incorporated herein by reference.

A preferred process to deposit a wear and corrosion resistant layer on the surface of machine parts in accordance with this disclosure reduces surface roughness by about 2–4 grades and corrects geometric error by the electrochemical treatment. Each grade represents half the surface roughness of the preceding grade. Thus, grade 1 represents a surface roughness of about 80 μm, grade 2 about 40 μm, grade 3 about 20 μm, etc. Accordingly, reducing the surface roughness by 2 to 4 grades represents a reduction of surface roughness to ¼–⅛ of the original surface roughness. These results may be achieved using a machine tool that includes a computer system that controls the motion and power pulse of whole process by intelligence control theory or "fuzzy logic".

Traditional manufacturing processes use a machine tool to obtain the precise shape and surface finishing. This requires the part to be processed at low cutting amount and high cutting speed on a machine with high stiffness and precision. In accordance with the novel process disclosed herein, this conventional process is replaced by an electrochemical plating process which utilizes a leveling agent to get same high level surface smoothness and a computer control system to get geometric precision. The automatic machine tool described herein performs an electrochemical precision flexibility manufacturing process. The basis of this process is to deposit a layer on the surface of the machine part, which confers resistance against wear and corrosion. After this process, the surface roughness of processed parts can be reduced about 2–4 grades because of the leveling agent in the plating solution. During the process, a sensor such as a magnetic tester or an optoelectronic sensor senses the shape of the part which is then converted to a signal, incorporating feedback to a computer control system. The motion and power pulse of whole process are controlled by fuzzy/intelligent control theory. For a geometric shape error in the part, either a positive or a negative pulse will be issued and layers of different thickness will be deposited on the surface to correct the geometric error of the part. So, the part precision will be increased, for example, 2–3 grades after processing due to the flexible touch of the anode cover (e.g., an absorbent flexible material such as those known to one skilled in the art of brush plating) with the processed part. Therefore requirements for stiffness and precision are lower than usual for a processing machine and the cost of equipment is reduced. Because there is an electrodeposited layer with wear resistance and corrosion resistance on the surface, some processes such as heat treating and surface protection (for example: electroplating, anodizing, black oxide, blued, etc.) are not necessary after this process. Therefore, the whole plating process is simplified and the cost is greatly reduced.

Figure 2:
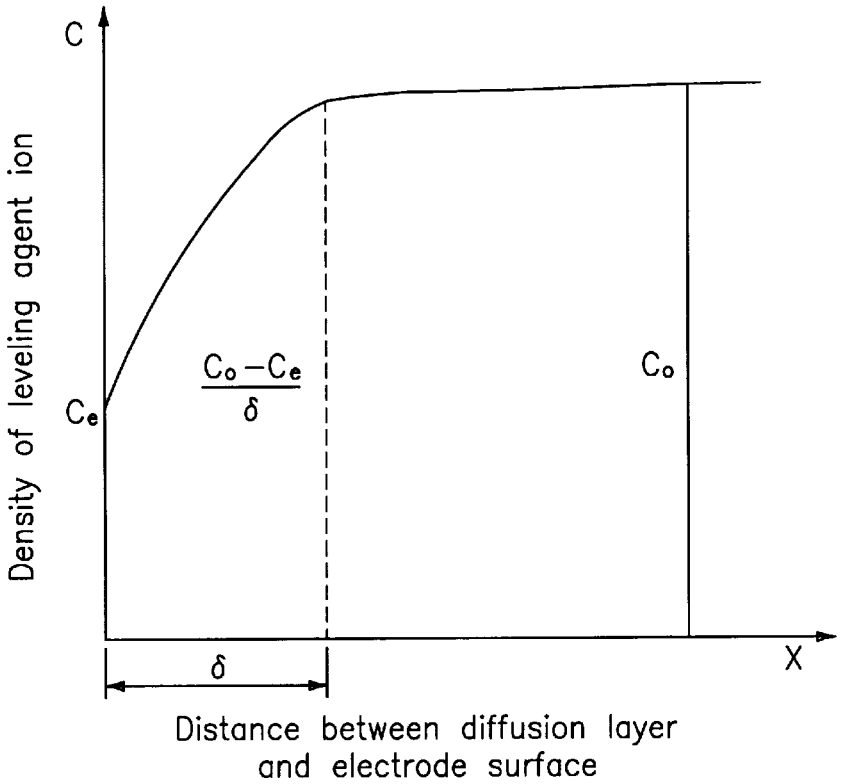
FIG. 2 is a graph of the distribution of leveling agent ion.

The leveling agent in the plating solution can increase the reaction inhibition of the electrodeposition and decrease the electrodeposition rate. Its distribution and action depend on the surface appearance (FIG. 1). The diffusion layer thickness of the leveling agent ions (FIG. 2) can be expressed in the form:

$$\delta = \frac{Co - Ce}{dc/dx} \tag{1}$$

wherein δ is diffusion layer thickness; Co is the density of the leveling agent ion; Ce is the density of the leveling agent ion which is near the electrode surface; dc/dx is the density gradient of the leveling agent ions.

From equation (1), it is known that the diffusion layer δ1 on the surface protrusions is relatively thin. The leveling agent ions become more dense than in other areas as the leveling agent ions diffuse easily. The diffusion layer δ2 on depression of surface is relatively thicker and it has very low reaction inhibition during the electrodeposition as the leveling agent ions diffuse to the depression area more sparsely. The electrodeposition rate is faster on the depression area than the protruding area. This process makes the micro-roughness decrease and meet the leveling requirement.

Figure 3:
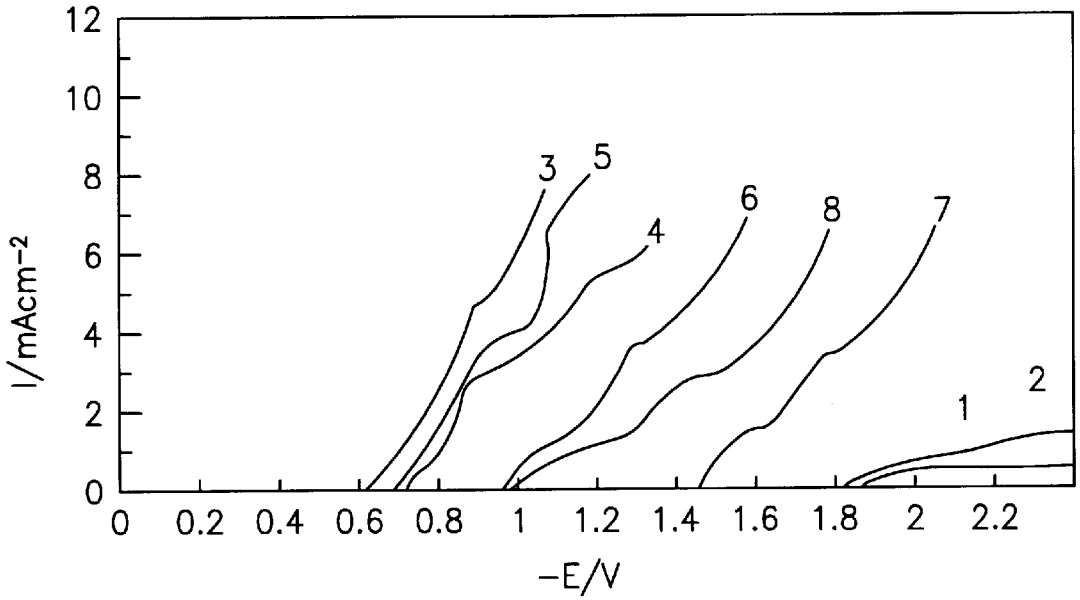
FIG. 3 is a graph illustrating deposition potentials of hydrogen evolution, iron, nickel and nickel+iron ions.

FIG. 3 shows the leveling agent has an inhibition action when the metal ions are electrodeposited. The deposition potential of Fe and Ni is −0.6174 v and −0.78 v respectively when there is no leveling agent in the solution. The deposition potential of Fe+Ni is −0.9810 v, which is very close to the potential of Fe. The leveling agent shifts the deposition potential of Fe (−0.369 v), Ni (−0.700 v), and Fe+Ni (−0.261 v) in a negative direction. Different thickness will be deposited on the micro-surfaces, according to the inhibition required by the surface appearance. After that, a very smooth surface can be obtained.

This integration of mechanical devices with microcomputers now gives the possibility for more intelligent control function. For this the overall control is performed in different levels including learning and adaptation, fuzzy control, and supervision. The present design is concerned with the measurement of the geometric error of the part, the fuzzy logic control of a power pack to generate the desired pulse sequence, and the control of the movement of a plating stylus so that geometric error (i.e., the deviation of the shape of the part from the desired geometry) can be reduced after processing.

Figure 4A:
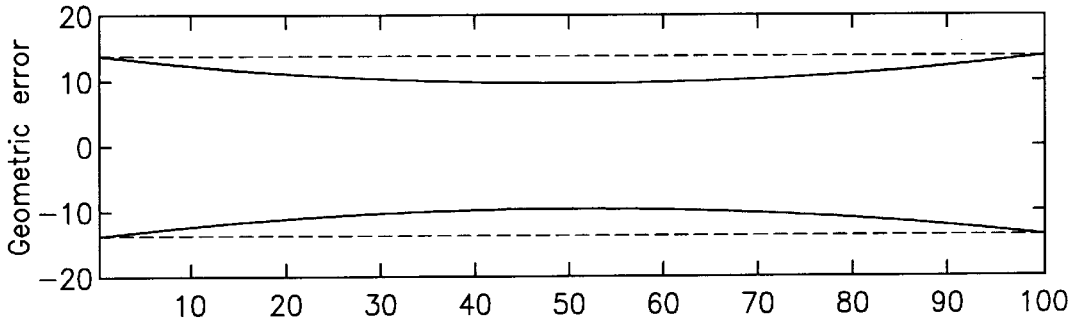
FIGS. 4(*a*), 4(*b*), and 4(*c*) illustrate, respectively the geometric error, pulse sequence, and speed of movement of the plating stylus correlated with shaft length.
Figure 4B:
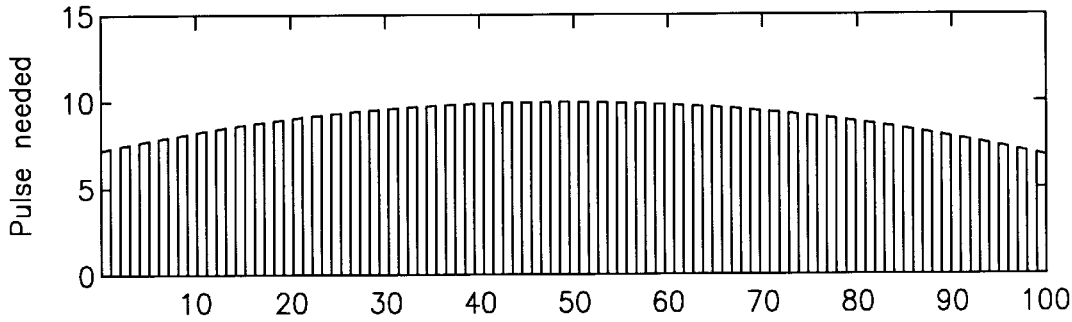
Figure 4C:
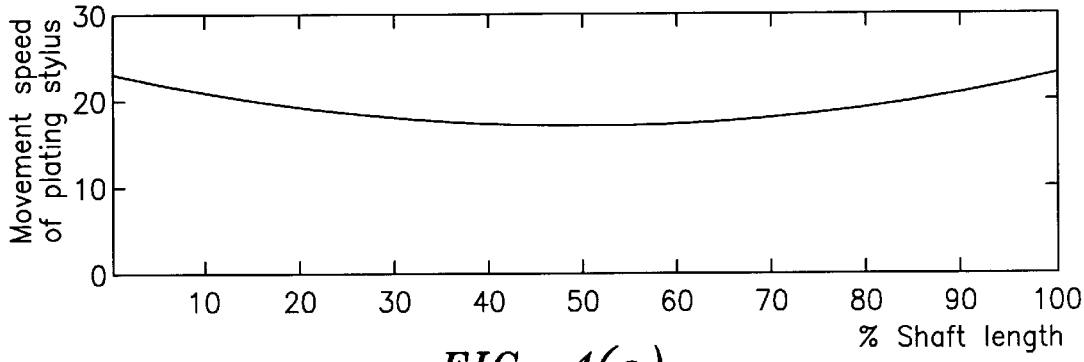

For example, one common problem from preliminary grinding of parts (e.g., shaft) is the geometric error as shown in FIG. 4(*a*), where dotted lines show the desired shape along a percentage of shaft length. As can be seen, the diameter of the part (represented by the curved lines) is at maximum deviation at about the center (50%) of the shaft length thus rendering the part slightly saddle shaped. To correct the geometric error, a pulse sequence as in FIG. 4(*b*) is needed so that more deposit can be achieved near the center of the shaft where the geometric error is large. As can be seen, the amplitude of the pulses, which is proportional to the amount of metal deposited, is increased near the center of the part length. This pulse sequence is preferably generated using a fuzzy logic control algorithm according to the geometric error measurement stored in a computer. The speed of movement of the plating stylus, i.e., the anode, is shown in FIG. 4(*c*). The plating stylus will move more slowly when thicker deposits are needed.

After processing using the present automatic machine tool, ten shafts, each 20 mm in diameter and 40 mm in length, were chosen at random to measure their dimensions and shape errors.

Table 1 shows dimension error of ten randomly selected parts after machine tool manufacturing. All the maximum and minimum standard deviation values are Φ20.00 mm within 0.3%.

Table 2 shows shape error after dimension measurement before and after processing (manufacturing) in accordance with the method described herein for selected distance. The part is saddle shaped but the error is small.

TABLE 1

Maximum and minimum standard deviation error

| No. | 1 | 2 | 3 | 4 | 5 | 6 | 7 | 8 | 9 | 10 |
|---|---|---|---|---|---|---|---|---|---|---|
| Max. Dimension f (mm) | $20^{+0.002}$ | $20^{+0.002}$ | $20^{+0.002}$ | $20^{+0.003}$ | $20^{+0.002}$ | $20^{+0.001}$ | $20^{+0.003}$ | $20^{+0.002}$ | $20^{+0.001}$ | $20^{+0.003}$ |
| Max. Dimension f (mm) | $20^{+0.001}$ | $20^{+0.000}$ | $20_{-0.001}$ | $20^{+0.001}$ | $20^{+0.000}$ | $20_{-0.002}$ | $20^{+0.001}$ | $20_{-0.001}$ | $20_{-0.002}$ | $20^{+0.001}$ |

TABLE 2

Comparison of saddle shape tolerance before and after

| Distance from Bottom (mm) | 5 | 15 | 25 | 35 |
|---|---|---|---|---|
| Before Manufacturing | $20_{-0.008}$ | $20_{-0.020}$ | $20_{-0.018}$ | $20_{-0.006}$ |
| After Manufacturing | $20^{+0.001}$ | $20_{-0.002}$ | $20_{-0.0015}$ | $20^{+0.001}$ |

Table 3 and Table 4 show the results of wear resistance and corrosion resistance and corrosion resistance after processing in accordance with this disclosure. As shown in Table 3, the wear rates of Cr, 7CrSiMnMoV steel, #45 steel and HT 300 cast iron were, respectively, 14%, 50%, 62%, and 79% greater than that of Ni-Fe-W-P alloy without lubrication. With lubrication, Cr showed 25% less wear resistance, but 7CrSiMnMoV steel, #45 steel and HT300 cast iron showed 50%, 87%, and 100% greater wear rate, respectively, than Ni-Fe-W-P alloy.

Table 4 illustrates the corrosion resistance of Ni-Fe-W-P alloy in comparison with Cr and Ni in NaCl and $H_2SO_4$ solutions. The corrosion rate V ($g/m^2$-hr) for Ni-Fe-W-P alloy in NaCl solutions was measured at 0.025. The corrosion rates for Cr and Ni in NaCl were 0.44 and 0.131 respectively, which represent 1.7 times and 5.2 times the rate of Ni-Fe-W-P.

Likewise, the corrosion rates of Cr and Ni is $H_2SO_4$ are, respectively, 1.38 and 3.44 higher than Ni-Fe-W-P alloy.

TABLE 3

Hardness and wear resistance of Deposits

| Material | Hardness | Wear Rate 1 | 2 | 3 | 4 | Average | Increase (%) |
|---|---|---|---|---|---|---|---|
| | | Without lubrication | | | | | |
| Ni—Fe—W—P | 700 | 0.90 | 0.70 | 0.70 | 0.78 | 0.77 | |
| Cr | 950 | 0.90 | 0.92 | 0.89 | 0.89 | 0.90 | 14 |
| 7CrSiMnMoV Steel | 560 | 1.10 | 1.10 | 1.20 | 1.20 | 1.15 | 50 |
| #45 Steel | 420 | 1.30 | 1.20 | 1.30 | 1.20 | 1.25 | 62 |
| HT300 Cast iron | 260 | 1.40 | 1.40 | 1.30 | 1.40 | 1.375 | 79 |
| | | With lubrication | | | | | |
| Ni—Fe—W—P | 700 | 0.30 | 0.40 | 0.40 | 0.40 | 0.375 | |
| Cr | 950 | 0.32 | 0.27 | 0.30 | 0.30 | 0.30 | −25 |
| 7CrSiMnMoV Steel | 560 | 0.60 | 0.60 | 0.60 | 0.60 | 0.60 | 50 |

TABLE 3-continued

Hardness and wear resistance of Deposits

| Material | Hardness | Wear Rate 1 | 2 | 3 | 4 | Average | Increase (%) |
|---|---|---|---|---|---|---|---|
| #45 Steel | 420 | 0.60 | 0.70 | 0.70 | 0.80 | 0.70 | 87 |
| HT300 Cast iron | 260 | 0.30 | 0.50 | 0.70 | 0.78 | 0.77 | 100 |

TABLE 4

Corrosion resistance of Deposits

| Deposit and System | Ni—Fe—W—P NaCl | Ni—Fe—W—P $H_2SO_4$ | Cr NaCl | Cr $H_2SO_4$ | Ni NaCl | Ni $H_2SO_4$ |
|---|---|---|---|---|---|---|
| Constant term | 0.661 | 0.762 | 0.724 | 1.223 | 1.25 | 1.311 |
| Regression coefficient (h) | 0.212 | 0.292 | 0.284 | 0.556 | 0.57 | 0.614 |
| Correlation coefficient (y) | 0.973 | 0.995 | 0.984 | 0.979 | 0.99 | 0.997 |
| $i_{corr}$ ($mA/cm^2$) | 0.0023 | 0.0069 | 0.0068 | 0.0018 | 0.0018 | 0.0208 |
| V- ($g/m^2 \cdot hr$) | 0.025 | 0.0837 | 0.044 | 0.116 | 0.131 | 0.288 |

Figure 5A:
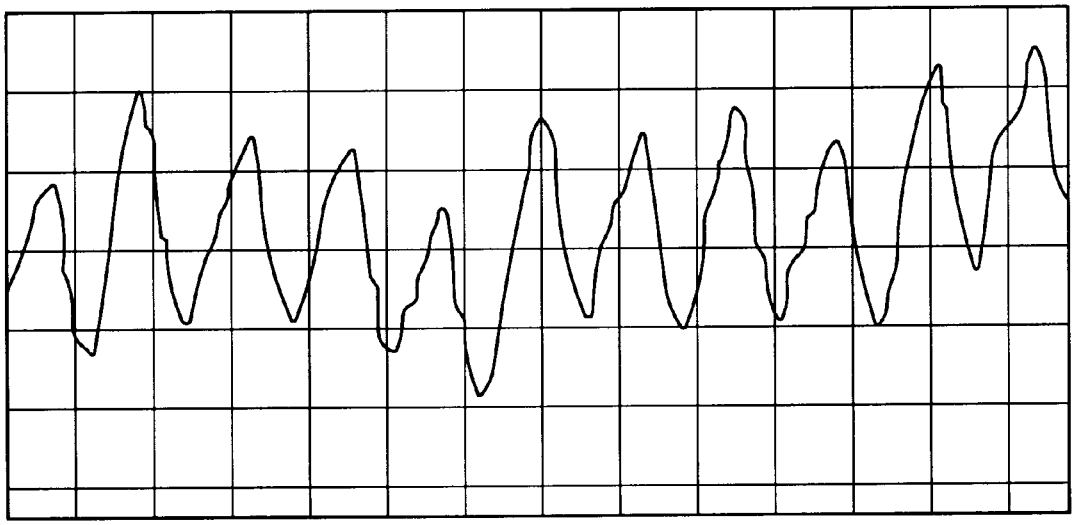
FIGS. 5(*a*) and 5(*b*) are graphical representations of surface smoothness of a substrate before and after plating, respectively.
Figure 5B:
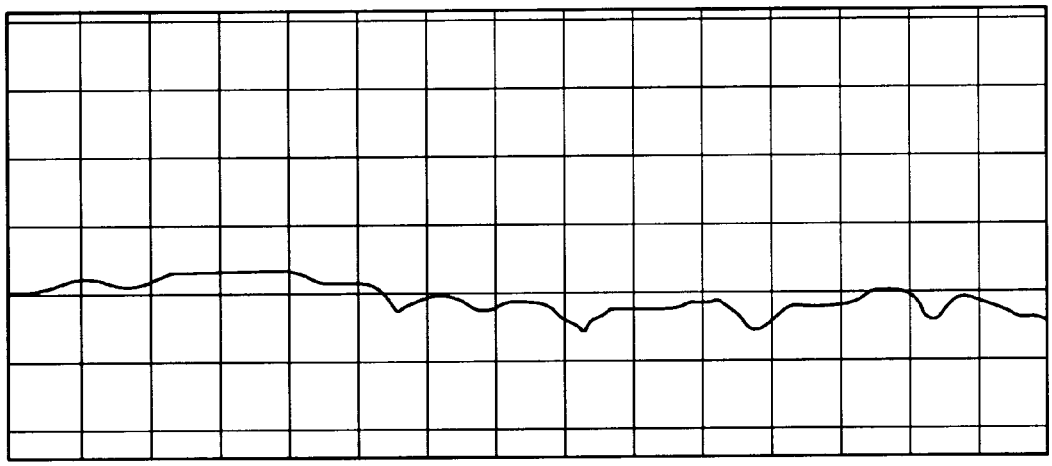

FIG. 5 shows the measurement results of surface roughness before and after processing in accordance with this disclosure. The small depression on the micro-surface is filled and leveled up and for the big depression the distance between peak and bottom decreases. After the present process is performed, the surface roughness decreases three grades.

The microstructure of deposits in accordance with this disclosure has been designed based on electrochemical metallurgy theory. It presents an amorphous matrix with fine intermetallic compound particles dispersed through it. This structure give the coating excellent multiple properties: high corrosion resistance provided by the amorphous matrix, high wear resistance provided by intermetallic compound particles. After treatment in accordance with the process described herein, some conventional processes such as heat treating and surface protection (for instance: electroplating, anodizing, black oxide, blued etc.) are not necessary.

A novel plating machine designed to work together with the plating solution described herein or independently has also been developed.

The product to be plated, i.e. the work piece, is mounted onto a support fixture which is rotatable around a preferably horizontal axis. The anode moves in a reciprocating fashion along the length of the work piece parallel to the axis of rotation. An applicator is attached to the anode and is in contact with the work piece. The applicator is capable of retaining fluid, typically by absorption or adsorption, and transmitting fluid to the work piece on contact therewith. The applicator can be of a fibrous structure (e.g., cotton wool, glass wool, bristles, etc.) or of a porous cellular structure (e.g., open celled synthetic polymer foam such as polyurethane foam, polypropylene foam and the like). The electrodeposition fluid is communicated to the porous member. In operation a pulsed direct current is charged to the support fixture and to the anode to cause the metal ions in the electrodeposition fluid to deposit onto the work piece as an Ni-Fe-W-P alloy. The work piece rotates while the anode reciprocates along the work piece during electrodeposition. These movements accelerate the molecular movement. The anode applicator touches only part of the part surface and the other surfaces that is not touched by the anode brush produces a passivating oxide film and thus stops grains from growing too fast. The friction between the anode applicator and work piece surface also helps slow down the grains from growing too fast. Preferably, the movement of the machine as well as the pulsed electric current is computer controlled.

As a result, the presently described process provides a deposition rate that is as much as 10 times faster than that of tank plating. Additionally, the deposited grains are finer than using tank plating, welding and metal spraying. Another benefit achieved by the present process is that the surface roughness is smoother than tank plating, welding and metal spraying.

In the process, a magnetic tester determines the product shape, converts it into electronic signals and sends them to a computer control system. Magnetic testers are known to those with skill in the art. A magnetic tester suitable for use in the method herein is available from Marposs SpA (Italy). The computer control system feeds this information back to control the motion and electric power pulse of the whole process. If the product shape has a geometric error, a positive or a negative pulse will be issued and layers of coating in different thickness will be deposited on the surface to correct the geometric error. Preferably, the whole process is controlled by fuzzy logic artificial intelligence.

Figure 6:
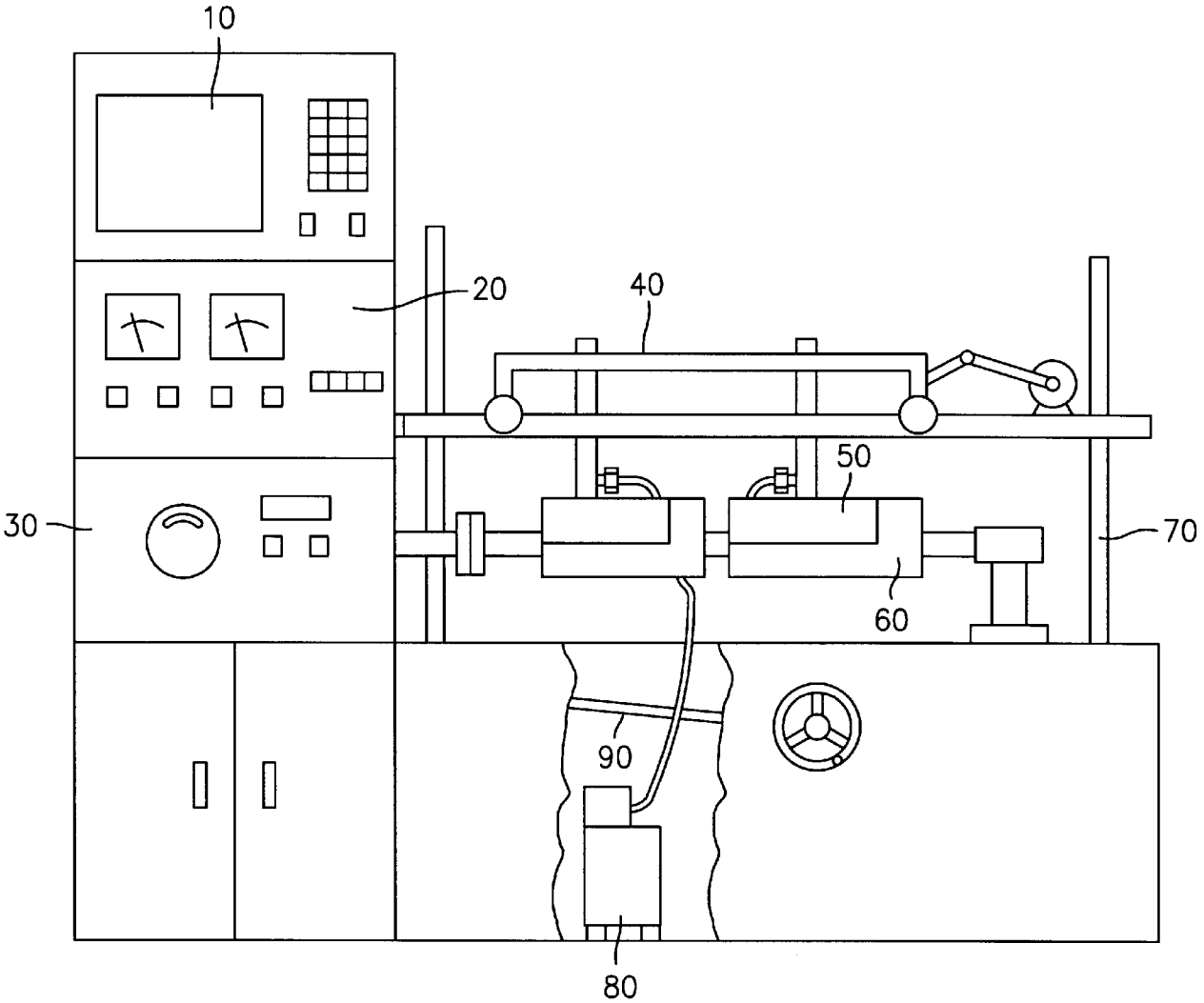
FIG. 6 is a diagrammatic illustration of an apparatus for electrodepositing an alloy onto a substrate.

As seen in FIG. 6, a suitable device includes a computer control system 10, power pack 20, and transmission case 30. Anode reciprocating transport mechanism 40 is used to move anode 50 and cylinder 60 in a reciprocating motion, while mechanism 70 is employed to move anode 50 in the up and down directions. The plating solution is pumped to anode 50 via solution cyclical pump 80 and excess plating solution is recovered in solution recovery tank 90.

Figure 7:
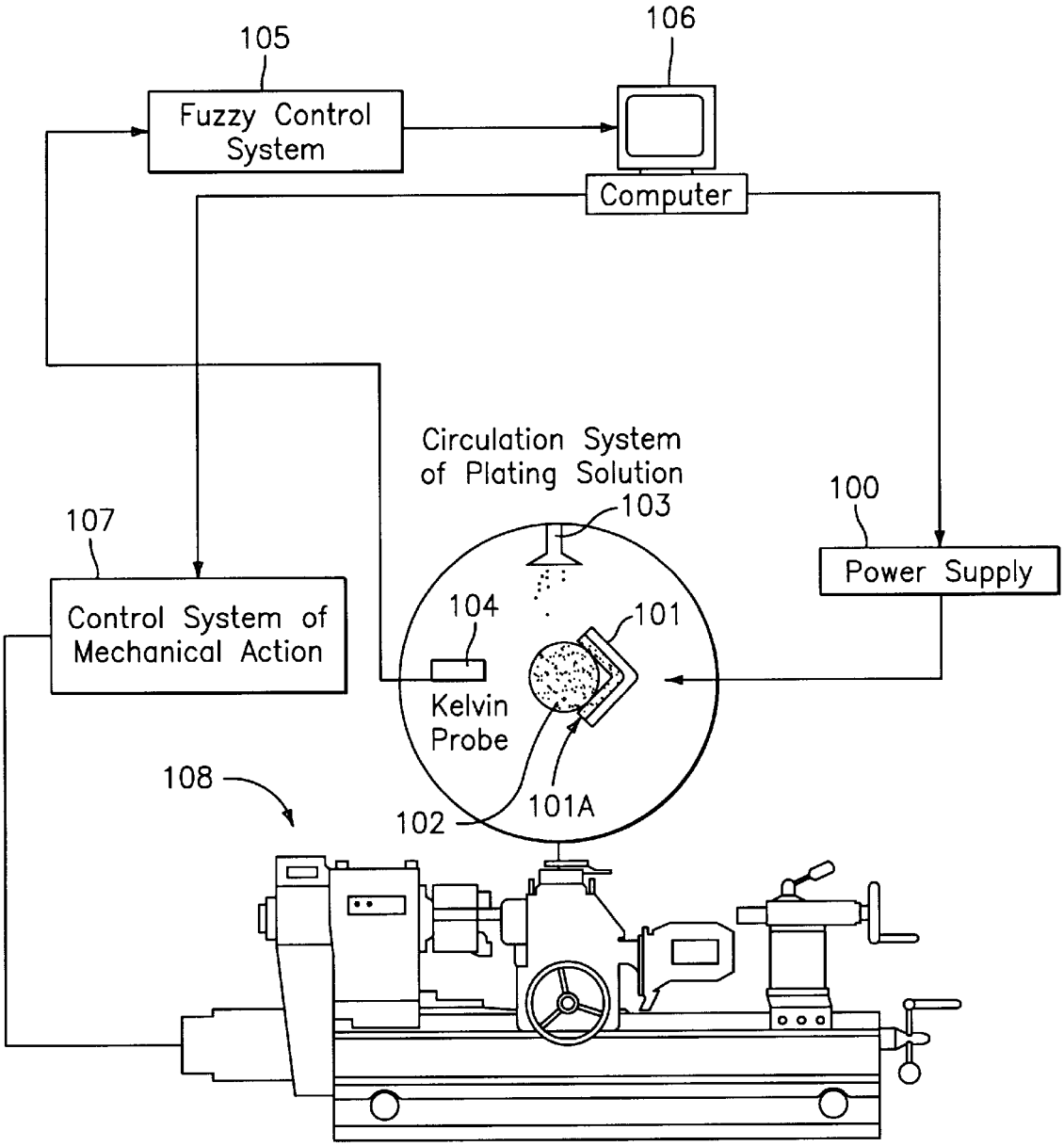
FIG. 7 is a flow chart showing the process control steps of a preferred process.

FIG. 7 is a flow chart showing the process controls steps of a preferred process in accordance with this disclosure. As can be seen, power supply 100 supplies pulsed current to anode 101 with applicator 101*a* in contact with work piece 102. Electrodeposition fluid is supplied via dispenser 103. The surface topography of the work piece 102 is measured by probe 104 which sends its signals to fuzzy logic control system 105. The control system calculates the magnitude of the geometric error of the work piece from the difference between the values of the actual topography of the work piece as measured by probe 104 and values of the desired topography of the work piece as stored in the computer memory. The computer 106, operating in accordance with the fuzzy logic control system 105, directs the operations of the power supply 100 and the mechanical control system 107, which controls movement of the apparatus 108. For example, the computer 106 can generate a corrective signal corresponding to the magnitude of the geometric error to the power supply 100. The power supply 100, in turn, applies a modified electric current to anode 101. The modified current effects deposition of a quantity of alloy sufficient to at least partially correct the geometric error by, for example, depositing more alloy over low spots in the work piece surface in proportion to the deviation of the actual topography from the desired exterior diameter of the work piece.

The following example is intended to illustrate certain aspects of the invention and is not intended to act as a limitation thereof.

EXAMPLE 1

Brass test-pieces 100 mm×20 mm×1 mm were used as substrates and layers with thickness of 30 $\mu$m were deposited of Ni-P, Ni-Fe, Ni-Fe-P, and Ni-Fe-W-P alloys.

The compositions of the respective electrodeposition solutions are shown in Table 5. The layers were deposited by a manual brush plating operation using stylus movement of 14–22 m/mm., voltage of 6–12 V and current of 60–100 A/dm$^2$. The anode was prepared by inserting a graphite rod into a holder connected to a power supply and the rod was wrapped in cotton-wool.

TABLE 5

The composition (g/liter) of electrodeposition solutions for Ni—P, Ni—Fe, Ni—Fe—P, and Ni—Fe—W—P alloy deposits.

| | Ni—P | Ni—Fe | Ni—Fe—P | Ni—Fe—W—P |
|---|---|---|---|---|
| $FeSO_4.7H_2O$ | | 30 | 30 | 30 |
| $NiSO_4.6H_2O$ | 80 | 200 | 200 | 200 |
| $NaWO_4.2H_2O$ | | | | 6–20 |
| $H_3PO_3$ | | | 40 | |
| $C_6H_8O_7$ | 60 | 60 | 60 | 60 |
| $NH_3.H_2O$ (ml/L) | 60 | | 20 | 40 |
| NaCl | 30 | | | |
| $NaH_2PO_2$ | 50 | | | 8 |
| $C_{13}O_2H_{11}Na$ | | 45 | 45 | 45 |
| pH | 9 | 2–4 | 2–4 | 2–4 |
| T (° C.) | 30 | 20–50 | 20–50 | 20–50 |
| DKA/dm$^2$ | 1–2 | 80–100 | 80–100 | 80–100 |

After the specimens were plated with the respective alloys, the corrosion rate of specimens was determined by Tafel Extrapolation. The specimens were immersed in the corrosion solution for more than 10 minutes to allow steady state conditions to be established. Anodic polarization curves were obtained by a Model 273 corrosion resistance tester available from EG&G Inc. of Wellesley, Mass.

Three solutions were used for the experiment: 50±1 g/l NaCl with pH in the region of 6.5–7.0 (ISO 3768), 1 M HCl, and 1M $H_2SO_4$.

The compositions of plating layers and their passive films were analyzed by energy dispersive X-ray analysis (EDAX) using an EDAX-9100 spectrometer, Auger emission spectroscopy (AES) using an AES-350 spectroscope, and X-ray photoelectron spectroscopy (XPS) using a PHI-550 spectrometer.

Figure 8:
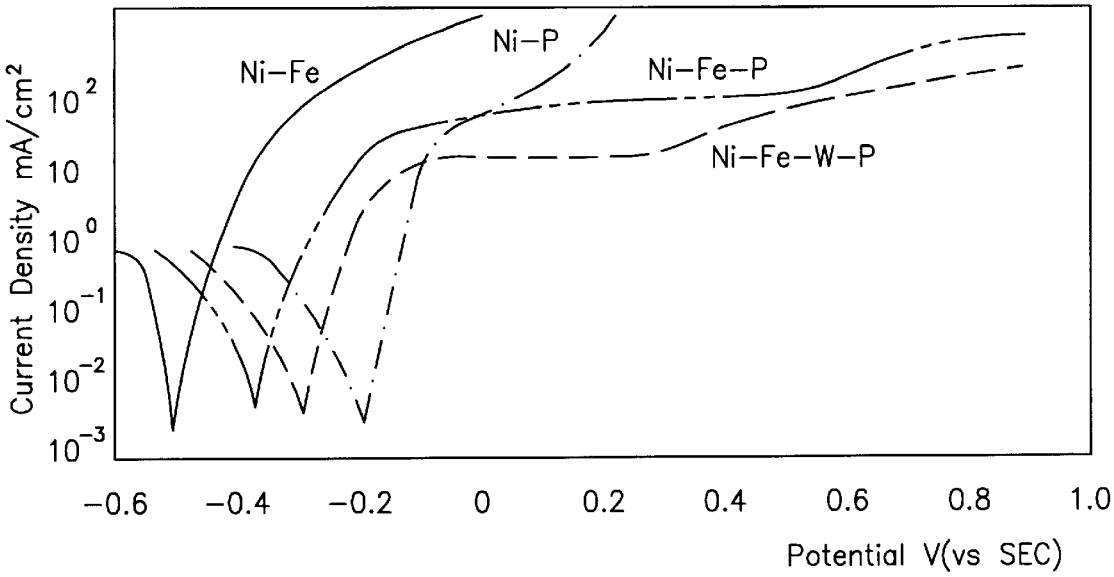
FIG. 8 is a graph of the anodic polarization curves of electrodeposited Ni-Fe, Ni-P, Ni-Fe-P, and Ni-Fe-W-P deposits.

The results shown in FIG. 8 indicate that the corrosion potential of Ni-P alloy, which has the highest P content in experimental alloys, is the most noble; the corrosion potential of Ni-Fe-W-P alloy is the second; that of Ni-Fe-P alloy is the third; that of Ni-Fe is the lowest. The anode polarization curves indicates that anode dissolution current of amorphous Ni-P alloy increases rapidly with the increase of electrode potential, whereas the anode dissolution current of alloy plating layer Ni-Fe-W-P, is the lowest at higher electrode potentials.

Figure 9:
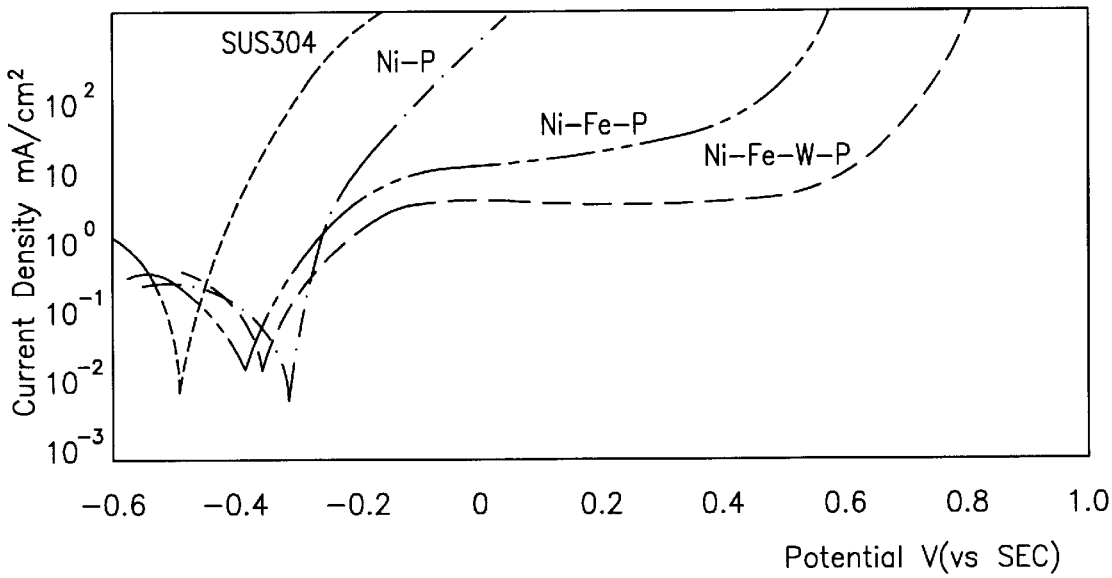
FIG. 9 is a graph of the anodic polarization curves of Ni-Fe based alloy deposits, and SU 503 in HCL solution.

A similar comparison of corrosion potential was made between SUS 304 stainless steel, and Ni-P alloy Ni-Fe-P alloy, and Ni-Fe-W-P alloy deposits. The results in FIG. 9 indicate that the corrosion potential of Stainless Steel SUS 304 is the most negative. Along with the more noble of electrode potential, the dissolution currently rapidly increases, the surface of the stainless steel was corroded, and a lot of holes appeared on the surface. If phosphorous is added in the plating layers, the corrosion potential will increase. Comparing with SUS 304, the corrosion potentials of alloy plating layers, such as amorphous Ni-P, Ni-Fe-P, and Ni-Fe-W-P increased about 300 mV. According to the Mixed Potential Theory, when the cathode process is under same condition, the more noble a metal corrosion potential is, the lower the corrosion current of the metal is. Comparatively, with the more noble of electrode potential the dissolution current of amorphous Ni-P alloy increases rapidly. Whereas the dissolution anode currents of the plating layers of Ni-Fe-W-P (W in 6% wt and P in 2% wt) decrease significantly with the increase of electrode potential.

Figure 10:
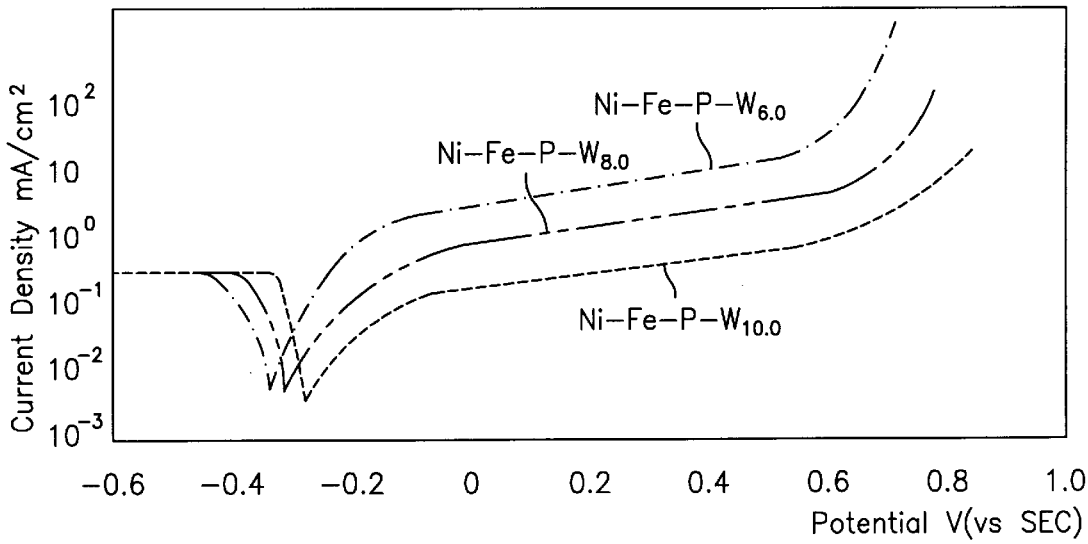
FIG. 10 is a graph of the anodic polarization curves of Ni-Fe-P-W deposits with different W contents.

FIG. 10 indicates that the dissolution currents decrease significantly with the increase of W content in the plating layers.

Figure 11:
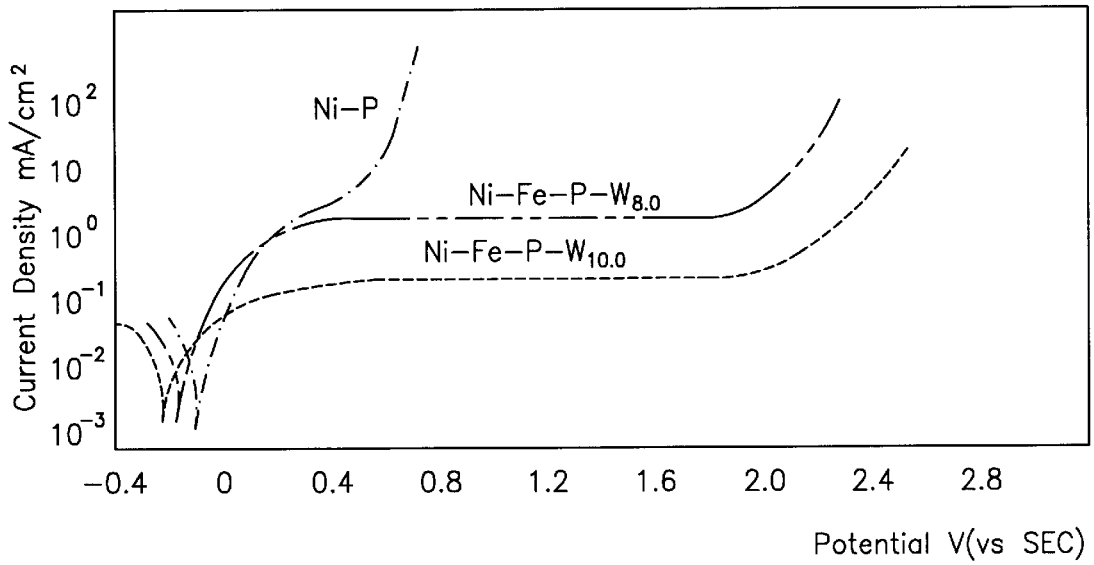
FIG. 11 is a graph of the anodic polarization curves of electrodeposited Ni-P and Ni-Fe-W-P alloy in $H_2SO_4$ solution.

The results in FIG. 11 indicate that the plating layers of Ni-P alloy dissolves rapidly with the more noble of electrode potential. Comparatively, the anode dissolution currently of Ni-Fe-P and Ni-Fe-W-P decrease significantly, the dissolution currents, moreover, decrease by a wide margin with the increase of W content in the alloys. The anode polarization curve shows that the group of Ni-Fe in the alloy plating layers will be passive in the $H_2SO_4$ solution if W is added. The range of the passivation potential is about 1200 mV. This shows that the corrosion resistance of amorphous plating layers Ni-Fe groups increase in $H_2SO_4$ solution when W is added.

Figure 12A:
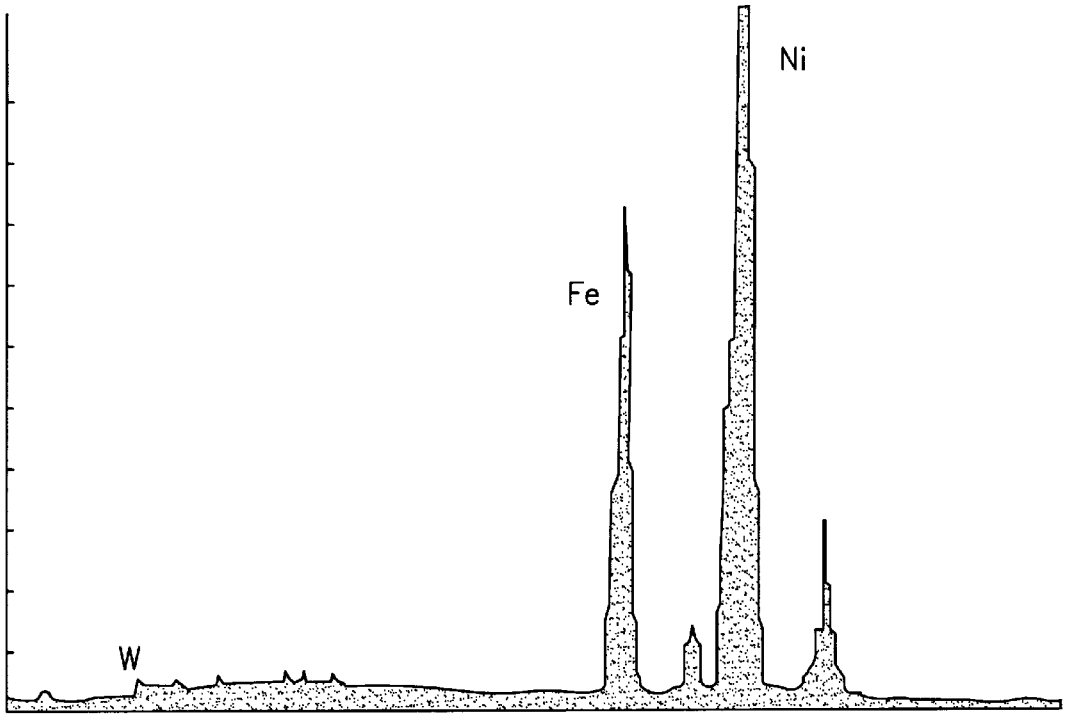
FIGS. 12(*a*) and 12(*b*) are graphs showing the results of EDAX analyses of Ni-Fe-W-P plating before and after corrosion, respectively.
Figure 12B:
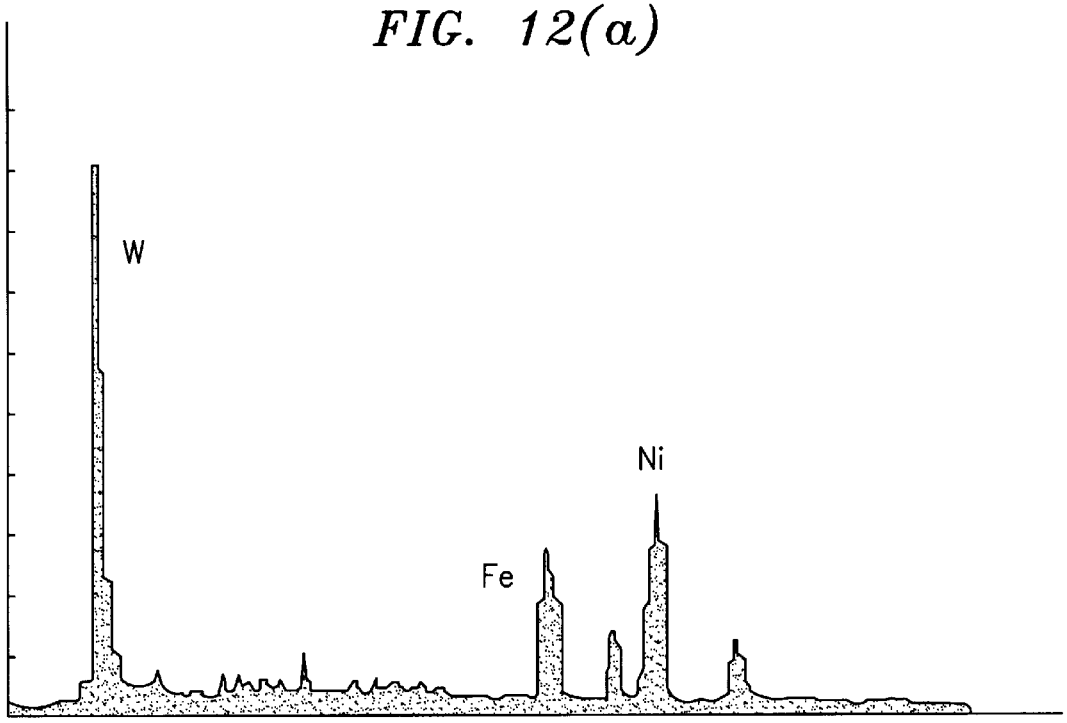

Analysis of the corrosion surface of the Ni-Fe-W-P plated layer by EDAX demonstrated an interesting phenomenon: during the corrosion process it was found that the metalloid in the amorphous alloy promoted the concentration of elemental tungsten in the passive film. The average content of W was increased from 5.5 to 50–70 wt %. See, FIGS. 12(*a*)–12(*b*). Furthermore, the segregated elemental tungsten can also form some oxides of low valence, such as $WO_2$, $W_2O_5$, and $WO_3$, which can passivate the plating layer.

$$WO_2+OH \rightarrow WO_3+H^+ +2e.$$

$$2WO_2+H_2O \rightarrow W_2O_5+2H^+ +2e$$

Figure 13A:
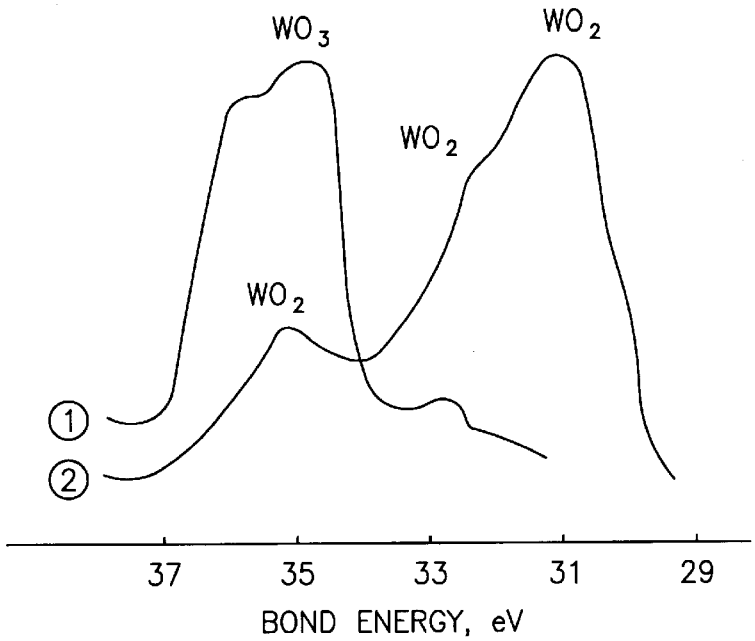
FIGS. 13(*a*) and 13(*b*) are graphs showing the results of XPS analysis before and after sputtering, respectively.
Figure 13B:
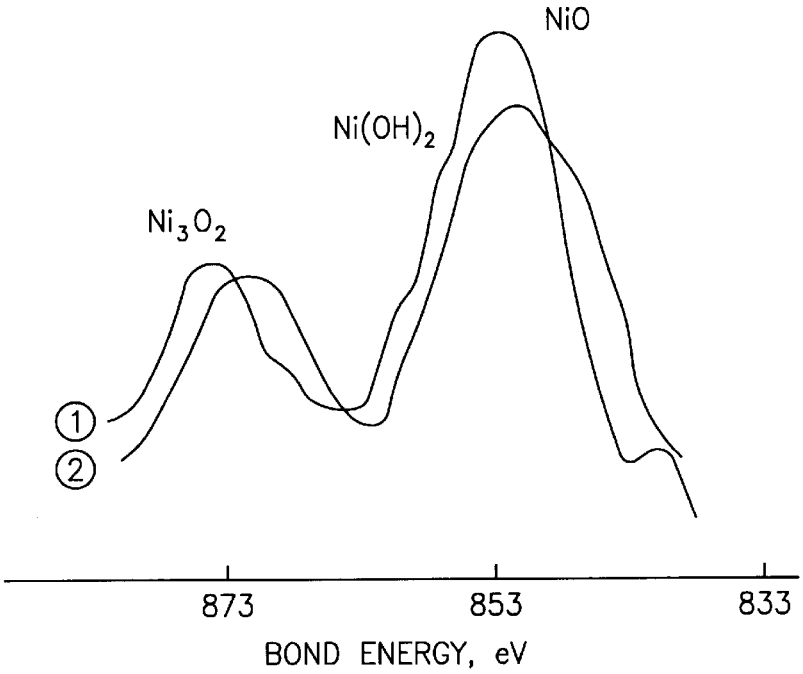
Figure 14A:
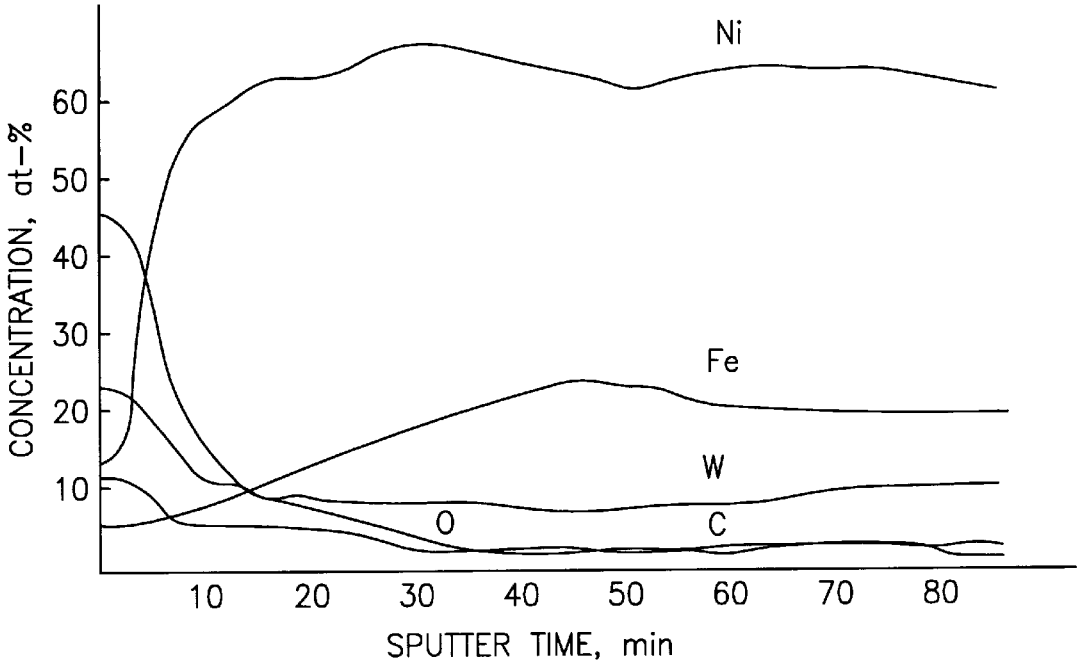
FIGS. 14(*b*) and 14(*b*) are graphs showing the results of AES analysis of possible film on a Ni-Fe-W-P layer before and after corrosion, respectively.
Figure 14B:
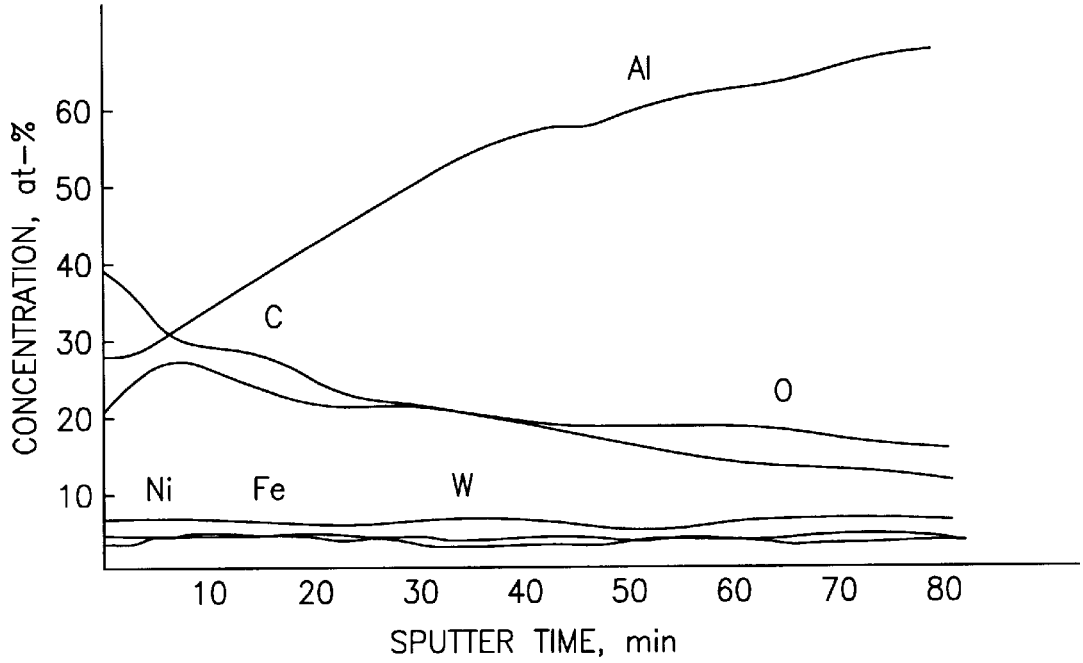

This has been verified by XPS analysis as shown in FIGS. 13(*a*)–13(*b*). The existence of the metalloid element in the plating coating can also promote the active dissolution of the alloy, which is one of the conditions necessary to form the passive film. The greater the rate of active dissolution, the faster the formation of the film and the milder will be the corrosion. The results of AES analysis of the passive film on the NI-FE-W-P plating layer are shown in FIGS. 14(*a*)–14(*b*). It can be seen that a great amount of oxygen is absorbed on the surface of passive film and most of it is present in the form of OH (bonding energy 531.2 eV) and O-M (bonding energy 530.3 eV), determined by XPS analysis. This is an important feature of the amorphous passive film, which is different from that on stainless steel.

From FIG. 14(*b*) it can be seen that the proportion of iron, nickel, and tungsten are quite small compared with oxygen. Referring to FIG. 13 it can be inferred that the oxygen, besides forming compounds with nickel and tungsten, is absorbed on the surface of the passive film in the form of free O or $OH^-$. According to adsorption theory for passive films, as long as the oxygen is absorbed on the most active thermochemical region, thus forming an electron double layer and so inhibiting the ionization of metal, it can play a protective role. In addition, the absorbed oxygen will react with the metal ions, thus promoting the rapid growth of passive film, so as to make it ductile, compact, and free from defects. It can also effectively inhibit the absorption of action anions on the passive film, and therefore increase its stability.

Those skilled in the art will envision many other possible variations that are within the scope and spirit of the invention as defined by the claims appended hereto. For example, those skilled in the art of fuzzy logic can develop various algorithms in accordance with the principles described herein to achieve various operable systems. In addition, those skilled in the art of software can employ traditional logic systems to achieve correction of geometric errors in surface topography. Therefore, while the above description contains many specifics, these specifics should not be construed as limitations on the scope of the invention, but merely as exemplifications of preferred embodiments thereof.

What is claimed is:

1. A method for electrodepositing a metallic coating onto a surface of an object, comprising the steps of:

preparing an electrodeposition fluid which contains in solution, based on the total metal content of the solution, from about 5 percent to about 15 percent by weight of iron, about 75 percent to about 90 percent by weight of nickel, about 3 percent to about 15 percent by weight tungsten, and about 0.5 percent to about 4.0 percent by weight phosphorous;

mounting the object on a support;

providing an anode which is movable over the object, the anode having an applicator in contact with a first portion of the surface of the object, a second portion of the surface of the object not being in contact with applicator;

supplying the electrodeposition fluid to the applicator; and supplying electric current to the anode and to the object to deposit an alloy containing nickel, iron, tungsten and phosphorus onto the object.

2. The method of claim 1 wherein the support has an axis around which the support is rotatable, and the method includes the step:

rotating the object around the axis and reciprocatingly moving the anode applicator parallel to the axis while depositing the alloy.

3. The method of claim 1 wherein the electrodeposition fluid contains from about 4 percent to about 8 percent by weight iron, from about 80 percent to about 84 percent by weight nickel, from about 5 percent to about 9 percent by weight tungsten, and from about 1 percent to about 3 percent by weight phosphorous.

4. The method of claim 1 wherein the electrodeposition fluid contains no more than about 1 gram per liter of $Fe^{+3}$ ions.

5. The method of claim 1 wherein the iron in the electrodeposition fluid is provided by a ferrous compound selected from the group consisting of ferrous sulfate, ferrous chloride, ferrous fluoborate and ferrous sulfamate, the nickel in the electrodeposition fluid is provided by a compound selected from the group consisting of nickel sulfate, nickel chloride and nickel sulfamate, the tungsten in the electrodeposition fluid is provided by a compound selected from the group consisting of sodium tungstate and tungstic acid, and the phosphorous in the electrodeposition fluid is provided by a compound selected from the group consisting of sodium phosphate and sodium hydrogen phosphate.

6. The method of claim 1 wherein the electrodeposition fluid contains a ceramic powder having a particle size of from about 1 to about 8 $\mu$m.

7. The method of claim 6 wherein the ceramic is a compound selected from the group consisting of alumina, silicon carbide, silicon nitride, zirconia, titania, chromium oxide, boron carbide and diamond.

8. The method of claim 1 wherein the electrodeposition fluid contains a reducing agent.

9. The method of claim 8 wherein the reducing agent is selected from the group consisting of ascorbic acid, isoascorbic acid, maleic acid, muconic glucoheptonate, sodium hydroquinone benzyl ether and aspartic acid.

10. The method of claim 1 wherein the electrodeposition fluid has a pH of from about 2 to about 3.

11. The method of claim 1 wherein the electric current supplied to the anode is in the form of pulses.

12. The method of claim 11 further including the step of controlling the pulsed electric current supplied to the anode by means of a controller.

13. The method of claim 12 wherein the controller employs fuzzy logic to at least partially level geometric errors on the surface of the object.

14. An apparatus for electrodepositing a metallic coating from a working solution onto a surface of a platable object, comprising:

a support for mounting the object, the support being rotatable around a horizontal axis;

an anode transport means for reciprocatingly moving the anode in a horizontal direction parallel to the axis of the support;

an applicator attached to the anode for contacting a selected portion of the surface of the object;

a fluid supply communicating with the applicator for supplying working solution to the selected portion of the surface of the object;

a power supply connected to the anode for creating an electrical potential between the object and the anode;

a sensor for measuring geometric error in the surface of the object and generating a signal corresponding to the geometric error; and a microprocessor responsive to the signal from the sensor and containing logic therein for effectuating correction of geometric error in surface topography of a platable object, the microprocessor being operatively is connected to the power supply and the sensor.

15. The apparatus of claim 14 wherein the applicator is selected from the group consisting of cotton wool, glass wool and open celled polymeric foam.

16. A method for leveling the surface of a platable object comprising:

providing a platable object operatively mounted to an electrodeposition apparatus, the platable object having a surface containing a geometric error in its surface topology;

providing a sensor for determining the surface topography of the object and generating a first signal corresponding to the surface topography;

sending the first signal to a microprocessor which compares the geometric error to a value corresponding to a desired surface topography of the object;

calculating the magnitude of the geometric error from the difference between the actual surface topography and the desired surface topography of the object;

generating a corrective signal corresponding to the magnitude of the geometric error;

sending the corrective signal to an electric current source thereby causing the electrodeposition apparatus to deposit onto the surface of the object a quantity of leveling agent sufficient to at least partially correct the geometric error of the platable object.

17. The method of claim 16 wherein the electric current is provided in the form of a series of pulses.

18. The method of claim 16 wherein generating the corrective signal is accomplished by means of a fuzzy logic algorithm.

19. An electrodeposition fluid which contains in solution based on the total metal content of the solution, from about 5 percent to about 15 percent by weight of iron, about 75 percent to about 90 percent by weight of nickel, about 3 percent to about 15 percent by weight tungsten, about 0.5 percent to about 4.0 percent by weight phosphorous, and a reducing agent.

20. The electrodeposition fluid of claim 19 wherein the electrodeposition fluid contains from about 4 percent to about 8 percent by weight iron, from about 80 percent to about 84 percent by weight nickel, from about 5 percent to about 9 percent by weight tungsten, and from about 1 percent to about 3 percent by weight phosphorous.

21. An electrodeposition fluid of claim 19 wherein the reducing agent is selected from the group consisting of ascorbic acid, isoascorbic acid, maleic acid, muconic glucoheptonate, sodium hydroquinone benzyl ether and aspartic acid.

* * * * *